United States Patent [19]

Alpaugh et al.

[11] 4,066,809

[45] Jan. 3, 1978

[54] METHOD FOR PREPARING SUBSTRATE SURFACES FOR ELECTROLESS DEPOSITION

[75] Inventors: Warren Alan Alpaugh, Chenango Forks; George Joseph Macur, Endwell; Gary Paul Vlasak, Owego, all of N.Y.

[73] Assignee: International Business Machines Corporation, Armonk, N.Y.

[21] Appl. No.: 700,428

[22] Filed: June 28, 1976

[51] Int. Cl.[2] ..... C23C 3/02

[52] U.S. Cl. ..... 427/444; 427/304; 427/305; 427/306; 427/97; 427/98

[58] Field of Search ..... 427/92, 98, 306, 305, 427/304, 444, 97

[56] References Cited

U.S. PATENT DOCUMENTS

| | | | |
|---|---|---|---|
| 3,698,940 | 10/1972 | Mersereau et al. | 428/209 |
| 3,817,774 | 6/1974 | Kuzmik | 427/304 X |
| 3,969,554 | 7/1976 | Zeblisky | 427/305 |

*Primary Examiner*—Ralph S. Kendall

*Attorney, Agent, or Firm*—Cyril A. Krenzer

[57] ABSTRACT

A three step seeding process with a hot water rinse and bake includes first contacting the surface of a substrate with a stannous chloride sensitizing solution, followed by a hot water rinse to remove any excess stannous chloride. Next, a palladium chloride activator is used to interact with the stannous compounds to form an adherent layer of metallic palladium particles. Thereafter, the surface is subjected to a palladium chloride/stannous chloride/HCL seeder bath which deposits a final catalytic layer on the surface and drilled through holes to facilitate the electroless plating of a metal of the substrate. A subsequent baking at a temperature between 105° C and 120° C sets the seeder on the substrate surface and in the through holes in the substrate.

9 Claims, No Drawings

METHOD FOR PREPARING SUBSTRATE SURFACES FOR ELECTROLESS DEPOSITION

BACKGROUND OF THE INVENTION

1. Field of the Invention

This invention relates generally to treating a dielectric material prior to the electroless deposition of a metal thereon and more particularly relates to an improved three step catalytic seeding method to prepare a dielectric material for the electroless deposition of a conductive metal thereon.

2. Description of the Prior Art

In the manufacture of printed circuit cards, boards and the like, a dielectric sheet material is used as a base upon one or both sides of which a suitable conductive circuit pattern is made. In a preferred method for generating such printed circuit assemblies, the circuitized patterns are generated using a plating process. However, since the dielectric base material is nonconductive, it is first necessary to generate a surface coating, or a predetermined surface pattern, using an electroless deposition technique to provide a thin conductive layer which may be further plated by conventional processes. When both surfaces of the dielectric base material are to be plated, it is also necessary to provide holes through the dielectric to permit the electrical interconnection between the various circuit configurations on the two surfaces.

The art of electroless deposition of conductive materials on dielectric substrates has been highly developed over the years as exemplified by U.S. Pat. Nos. 3,011,920, 3,099,608 and 3,632,388. In U.S. Patent 3,011,920, the method for catalyzing the dielectric substrate includes sensitizing the substrate by first treating it with a solution of a colloidal metal, accelerating the treatment with a selective solvent to remove protective colloids from the sensitized dielectric substrate and then electrolessly depositing a metal coating on the sensitized substrate; for example, with copper from a solution of a copper salt in a reducing agent. U.S. Pat. No. 3,099,608 pretreats a dielectric substrate by depositing a thin film of a "conductivator" type of metal particle such as palladium metal from a semicolloidal solution onto the dielectric substrate to provide a conducting base which permits electroplating with conductive metal on the conductivated base. U.S. Pat. No. 3,632,388 discloses a method for treating a polymeric plastic substrate in a plating process which utilizes a preliminary chromic acid etch followed by a one step activation in a tin-palladium hydrosol.

The foregoing prior art methods have provided satisfactory results for electroless deposition or electroplating thin layers of conductive materials on nonconductive dielectric substrates for most prior art applications. However, with the advent of high circuit densities for printed circuit boards, coupled with reduced line widths and thinner dielectric base materials, the foregoing processes are not totally capable of providing high quality boards with the desired reliability.

With the increased circuit densities have come the requirements that the plated through holes between the sides of the printed circuit boards, or between a number of circuit boards in a multilayer package, have a substantially reduced diameter so that the actual area for plating in the through holes has been significantly decreased. This results in a reduced plating area in the through holes and as a result any deficiency in the seeding or plating process will become more evident.

It has been found that using the prior art seeding techniques, voids can exist in the plated through holes, regardless of how long the board is left in the plating bath. While the exact reason for this is not known, one theory is that the extended exposure of the plated through hole to the plating bath may cause removal of the seeder from the surface of the plated through hole with the result that no adhesion of the electrolessly deposited metal can occur. It has been found that the longer a board must be immersed in an electroless bath before the catalyst is covered with copper, the more likely it is that there is removal of the catalytic seeder from the surfaces of the board. Typically, the electroless deposition take time following prior art seeding processes has been on the order of sixty to ninety minutes.

Another problem that has become evident with the advent of the higher circuit densities, the thinner dielectric materials and the higher aspect ratio of the through holes is the phenomenon of copper wicking. This is due to the absorption of copper into the glass fiber bundles, the absorption of which is directly related to the amount of time that the dielectric is immersed in the electroless deposition bath before initial coverage. With the thinner dielectrics, there has been a substantial increase in the number of internal shorts detected in making circuit boards with the prior art processes. It is therefore apparent that the longer a dielectric must remain in an electroless deposition bath before initial coverage, the more likelihood that increased copper wicking will occur with the resultant evidence of internal shorts through the dielectric.

OBJECTS AND SUMMARY OF THE INVENTION

Accordingly, it is a principal object of this invention to provide an improved catalytic seeding method to prepare a dielectric substrate for the electroless deposition of a conductive metal thereon which overcomes the foregoing disadvantages of the prior art.

Another object of the invention is to provide an improved catalytic seeding method to prepare a dielectric substrate for the electroless deposition of a conductive metal thereon which substantially reduces the resulting take time for the electroless deposition of the conductive metal.

Yet another object of the present invention is to provide an improved catalytic seeding method to prepare a dielectric substrate for the electroless deposition of a conductive metal thereon which provides a more uniform coating of the catalytic seed on the areas of the substrate to be covered by the electroless deposition.

Yet another object of the present invention is to provide an improved catalytic seeding method to prepare a dielectric substrate for the electroless deposition of a conductive metal thereon which will result in substantially reduced metal wicking during the subsequent electroless deposition of the conductive metal.

Briefly, the foregoing and other objects are accomplished according to one aspect of the invention wherein the dielectric substrate to be plated is first prepared by drilling any through holes required and the dielectric substrate is appropriately cleaned. Next, the dielectric substrate is contacted with a stannous chloride sensitizing solution to condition the substrate surfaces and through holes by depositing thereon a layer of $Sn^{+2}$. The stannous chloride is then rinsed from the board with hot water following which the dielectric substrate is contacted by a palladium chloride activator. After being contacted by the palladium chloride activator, the substrate is subjected to a palladium chloride/stannous chloride/HCl seeder bath, following which it is removed from the solution and baked dry at a temperature of at least 105° C.

DESCRIPTION OF THE PREFERRED EMBODIMENT

The foregoing and other objects, features and advantages of the invention will be apparent from the following more particular description of the preferred embodiments thereof.

While the following detailed description relates to a method for preparing a dielectric substrate for the electroless deposition of copper thereon, it will be readily apparent that other compatible metals, such as nickel, can also be electrolessly deposited using the method of the present invention.

Prior to the initiation of the process of seeding the dielectric substrate, the required through holes in the circuit board are made and the dielectric with the through holes is suitably cleaned and preconditioned. The first seeding step includes the contacting of the dielectric substrate surfaces and the through holes with a stannous chloride sensitizing solution ($SnCl_2$/HCl). Typically, the contacting time is from 4 to 10 minutes with a preferred contact time of seven minutes. Contacting the dielectric surface with this solution conditions the surfaces including the through holes by depositing thereon a layer of tin ($Sn^{+2}$). The stannous chloride is then rinsed from the substrate and through holes with water. A hot water rinse being in a temperature range from 55° C to about 80° C is preferred. The hot water removes any excess stannous chloride and also hydrolizes the $SnCl_2$ on the surface to produce gelatinous tin hydrous oxides, which are absorbed on the surface of the board as a stannous complex.

The next seeding step includes contacting the dielectric substrate surfaces including the through hole surfaces with a palladium chloride activator in which divalent palladium interacts with the stannous compounds on the board surface to form an adherent layer of metallic palladium particles thereon. This may be accomplished by immersing the dielectric in the palladium activator bath for 2 ± 1 minutes. This step promotes the adhesion of the final seeding step and increases the concentration of the final catalytic layer which is deposited in the final seeding step.

The third step of the seeding process includes contacting the substrate surface and through hole surfaces with a palladium chloride/stannous chloride/hydrochloric acid seeder bath. While a preferred contact time of five minutes is desired, it has been found that the actual contact time can vary from one to ten minutes and still provide satisfactory results. This step deposits the final catalytic layer which permits the additive metal such as copper to be plated electrolessly on the surface and in the through holes of the dielectric substrate. The concentrations of the individual materials in the bath of the third step of the seeding process are critical and must be controlled within fairly tight limits to maintain the desired catalytic seeding.

After the three step seeding process is completed, the substrate is baked dry at a temperature of at least 105° C and preferably between 105° C and 120° C, which baking operates to set the seeder on the surface and in the through holes of the circuit board substrate.

It is found that the two preliminary steps including the use of the stannous chloride sensitizing solution and the palladium chloride activator promote a substantial deposition of the seeder from the third step of the process to avoid plating voids which otherwise occur in the holes and on the surface using prior art techniques. That is, it has been found that without these first two steps, insufficient seeder is deposited on the board and in the through holes. It is also found that the baked dry step following the seeding process apparently operates to firmly set the catalytic seed on the surface and in the through holes. It is further found that the hot tap water rinse significantly improves the absorption of the tin complex after the sensitizing step; that is, the initial preconditioning step of the process.

Using this three step seeding process, it is also found that the subsequent take time for the electroless deposition of the conductive metal on the catalyzed surfaces is significantly reduced. This substantially diminishes the wicking phenomenon that occurred with prior art systems. It also results in reduced voids of the electrolessly deposited metal on the sensitized surfaces.

In preparing the solution for the first step of the process, it is found that the combination of stannous chloride having a content of between 53 and 57 grams per liter of $SnCl_2 \cdot 2H_2O$ with 37% hydrochloric acid at a ratio of 50 milliliters per liter with the pH of the solution adjusted to a range between 0.2 and 0.5 provides a desired preconditioning solution. The $SnCl_2 \cdot 2H_2O$ is dissolved in the HCl with the resulting mixture being added to a tank of deionized water. It is generally found that the optimum results are obtained when the pH is approximately 0.4 and the solution is maintained at a temperature of 65° ± 10° F.

For the second preconditioning step of the process, the palladium chloride bath is formed by mixing 50 grams of palladium (with a concentration of 0.13 to 0.17 grams per liter) with approximately 3780 milliliters of 37% hydrochloric acid (having a concentration of 10 milliliters per liter). The $PdCl_2$ is dissolved in the hydrochloric acid with the resultant mixture being added to a tank of deionized water. Again, the bath is maintained at a temperature of 65° ± 10° F., the pH is maintained between 0.75 and 1.00 and the copper content of the solution is kept below 50 parts per million.

The final catalytic palladium chloride/stannous chloride/hydrochloric acid seeder bath includes a bath comprising 1.2 to 2.5 grams per liter of $PdCl_2$ with 80 to 150 grams per liter of $SnCl_2 \cdot 2H_2O$ together with between 290 and 360 milliliters of 37% HCl per liter of solution. This third seeding bath is again maintained at a temperature of 65° ± 10° F. The optimum solution of the bath includes about 1.5 grams per liter of $PdCl_2$, 100 grams per liter of $SnCl_2$ and 280 milliliters per liter of 37% hydrochloric acid.

Using the three step seeding process according to the present invention, it has been found that the take time for the subsequent electroless deposition of the conductive metal is on the order of five to fifteen minutes compared to the sixty to ninety minutes nominally required following prior art seeding techniques. This faster take time results in less metal wicking and fewer plating voids on the plated surfaces.

While the invention has been described in terms of the preferred embodiment thereof, it will be readily apparent to those skilled in the art that other modifications and variations may be made therein without departing from the scope or spirit of the invention. It is therefore intended that the invention not be limited to the specifics of the foregoing description of the preferred embodiment, but rather is to embrace the full scope of the following claims.

We claim:

1. A method for conditioning the surfaces of a dielectric base material for the electroless plating of a conductive metal thereon, comprising the steps of:

contacting the surfaces of the dielectric base material with an aqueous stannous chloride sensitizing solution comprising between 53 and 57 grams per liter of $SnCl_2 \cdot 2H_2O$ with 37% HCl at a ratio of 50 milliliters per liter;

rinsing the excess stannous chloride solution from the surfaces with hot water;

contacting the surfaces of the dielectric base material with an aqueous palladium chloride activator solution, said aqueous palladium chloride activator solution formed by mixing about 50 grams of palladium chloride having a concentration of 0.13 to 0.17 grams per liter with approximately 3780 milliliters of 37% hydrochloric acid having a concentration of 10 milliliters per liter;

contacting the surfaces of the base material with an aqueous palladium chloride/stannous chloride/hydrochloric acid seeder bath, said palladium chloride/stannous chloride/hydrochloric acid seeder bath comprising from 1.2 to 2.5 grams per liter of $PdCl_2$, from 80 to 150 grams per liter of $SnCl_2 \cdot 2H_2O$, and from 290 to 360 milliliters per liter of 37% HCl; and, baking the base material at a temperature of at least 105° C.

2. The invention according to claim 1 wherein the temperature of the hot water in the rinsing step is between 55° C and 80° C.

3. The invention according to claim 1 wherein the temperature for the baking step is between 105° C and 120° C.

4. The invention according to claim 1 wherein the pH of said stannous chloride sensitizing solution is adjusted to a range between 0.2 and 0.5.

5. The invention according to claim 4 wherein the pH of the stannous chloride sensitizing solution is about 0.4.

6. The invention according to claim 4 wherein the temperature of said stannous chloride sensitizing solution is maintained at 65° ± 10° F.

7. The invention according to claim 1 wherein the pH of said palladium chloride activator solution is between 0.75 and 1.00.

8. The invention according to claim 7 wherein the temperature of said palladium chloride activator solution is maintained at 65° ± 10° F.

9. The invention according to claim 1 wherein said seeder bath comprises about 1.5 grams per liter of $PdCl_2$, 100 grams per liter of $SnCl_2$, 280 milliliters per liter of 37% HCl and said bath is maintained at a temperature of 65° ± 10° F.

* * * * *